US006044741A

United States Patent [19]

Sapp et al.

[11] Patent Number: 6,044,741

[45] Date of Patent: Apr. 4, 2000

[54] UNITARY TRAY AND BLADE GUIDE MOUNT FOR A FOOD PROCESSING MACHINE

[75] Inventors: Michael H. Sapp, Hilliard; Thomas L. Lease, Westerville; Thomas A. Hochanadel, Blacklick, all of Ohio

[73] Assignee: J. E. Grote Company, Inc., Blacklick, Ohio

[21] Appl. No.: 09/069,345

[22] Filed: Apr. 29, 1998

Related U.S. Application Data

[60] Provisional application No. 60/045,125, Apr. 30, 1997.

[51] Int. Cl.[7] ..... B26D 3/26

[52] U.S. Cl. ..... 83/468.7; 83/932; 83/419; 83/703; 83/813

[58] Field of Search ..... 83/856, 932, 468.7, 83/707, 713, 730, 444, 450, 419, 703, 813

[56] References Cited

U.S. PATENT DOCUMENTS 1,320,261 10/1919 Melerski ..... 83/444
5,765,472 6/1998 Kim ..... 83/932 X

*Primary Examiner*—Rinaldi I. Rada
*Assistant Examiner*—Dominic J Troiano
*Attorney, Agent, or Firm*—Jason H. Foster; Kremblas, Foster, Millard & Pollick

[57] ABSTRACT

A unitary tray and blade guide frame including longitudinal members extending from rigid, integral attachment with a back tray. An end frame member transversely, rigidly mounts to the longitudinal frame members and the back tray. A blade guide mounts to the back tray, with its upper surface flush with the upper surface of the back tray. A thickness tray slidably mounts in slots formed in the longitudinal frame members. An adjustment mechanism adjusts the position of the thickness tray. A food product workpiece extends downwardly from a reciprocatably displaceable workpiece retaining carriage, and rests on the upper surface of the thickness tray. The carriage advances the workpiece into a blade, which removes a slice from the workpiece. The lower surface of the remaining workpiece slides against the upper surface of the blade guide and the back tray. A coupling for drivingly linking a rotary motor driveshaft with a driven pulley, including a pair of feet extending perpendicularly from, and on opposite sides of, the driveshaft. The feet extend into a gap between a pair of fingers extending perpendicularly from the face of the pulley. The fingers are equidistantly spaced on opposite sides of the axis of rotation of the pulley. Elastic bushings are mounted to the feet, and rollers are rotatably mounted to the fingers. Rotation of the driveshaft abuts the feet against the fingers, exerting a force on the fingers which rotatingly drives the pulley.

8 Claims, 11 Drawing Sheets

UNITARY TRAY AND BLADE GUIDE MOUNT FOR A FOOD PROCESSING MACHINE

CROSS-REFERENCES TO RELATED APPLICATIONS

This application claims the benefit of U.S. Provisional Application Ser. No. 60/045,125 filed Apr. 30, 1997.

BACKGROUND OF THE INVENTION

1. Field of the Invention

This invention relates broadly to a food processing machine in which a food product workpiece is reciprocatingly displaced through a cutting blade. The invention more specifically relates to a mounting frame for the trays on which the food workpiece slides and the blade guide which guides the cutting blade. This invention additionally relates to a coupling for drivingly linking a rotary drive motor to a pulley in a food product slicing machine.

2. Description of the Related Art

Food processing machines form slices of food product by moving a food product workpiece through a blade. Examples of such machines are shown in U.S. Pat. No. 3,760,715 to Grote et al., and U.S. Pat. No. 4,436,012 to Hochanadel, which are incorporated by reference. In both of these machines, a food product retaining carriage is reciprocatingly displaced through a path which includes a slicing blade, such as the endless loop blade disclosed in U.S. Pat. No. 4,230,007 to Grote et al., which is incorporated by reference. As the food product is displaced through the blade, a thin slice is removed from the food product workpiece and falls downwardly from the blade. The machines can slice thousands of slices of meat, cheese, vegetables and other foods each day. Cleaning of all parts which contact the food is necessary at least once daily to prevent unacceptably high levels of bacteria on the machines.

The conventional method of cleaning food processing machines includes removing all easily detached parts for submersion cleaning in a bath, and high pressure spraying of the remaining parts. One portion of cutting machines which is particularly susceptible to food buildup, and is particularly difficult to clean, is the blade drive components. This includes a pair of pulleys around which the flexible, endless loop blade extends. Conventionally, one of the pulleys is an idler pulley which rotatably mounts to the frame of the machine by a roller bearing. The second of the pulleys is driven by an electric, rotary motor, the driveshaft of which is directly connected to the driven pulley by a spline shaft, for example. Removal of the pulley requires the removal of a nut from a threaded portion of the driveshaft. Reattachment after cleaning involves re-tightening the nut and adjusting the alignment of the pulley. Removal of the idler pulley is similarly difficult and requires hand tools which can be misplaced. Because it is difficult to remove the pulleys, they are not ordinarily detached for cleaning, but cleaned by merely directing a high-pressure spray onto and behind them to remove whatever food particles can be reached by the spray. This cleaning method can be ineffective unless care is taken to clean all surfaces.

Another region of the machine that is difficult to clean, and is additionally susceptible to relative shifting over a period of time, includes the trays on which the reciprocating food product workpiece rests. In the slicing machines discussed in the three referenced patents, there are three elements against which the lower end of the food product workpiece slides during reciprocating displacement of the workpiece. The thickness tray is a planar or curved surface which the workpiece rests upon at the beginning of the cutting cycle. The thickness tray is attached to the frame of the food product slicing machine. The machine frame is the portion of the machine that provides mounting support for most of the distinct, attached parts of the machine. This can be a skeleton of very sturdy, interconnected beams and bars, or a unit-body construction in which panels and sheets are connected to form the frame, such as in an automobile frame. The frame can also consist of a combination of the two types.

Also attached to the machine frame, and spaced slightly from one longitudinal end of the thickness tray to form a gap, is a blade guide. The blade guide has a slot formed along the entire length of the side nearest the gap. The endless loop blade is positioned in the blade guide slot and advanced continuously to slice food products which are brought into contact with the blade.

An upper, planar surface of the blade guide is flush (i.e. coplanar) with an upper, planar surface of a back tray. The back tray is rigidly mounted to the machine frame on the opposite side of the blade guide from the thickness tray. A food product workpiece initially rests on the thickness tray, and is displaced into the blade to remove a slice. The remaining part of the workpiece (directly above the slice) slides past the blade onto the upper surfaces of the blade guide and the back tray.

The thickness tray, back tray and blade guide are conventionally separately mounted to the machine frame by removable fasteners, such as bolts. These trays are cleaned by high pressure spray, or complete removal for submersion in a bath. Removing these parts is time consuming and requires tools, as with the pulleys in the conventional machine. Additionally, because the back tray, blade guide and thickness tray are all attached to the primary frame elements of the machine, any significant force applied to the machine frame can cause the trays and blade guide to become misaligned relative to one another. Misalignment will cause slices to be improperly formed. The force which misaligns the trays and blade guide can be a single, sudden impact, or repetitive vibratory forces applied over a long period of time.

Therefore, the need exists for a food product slicing machine having more easily removed parts, requiring few tools for disassembly and which reduces the problem of misalignment over time.

SUMMARY OF THE INVENTION

The invention is an improved structure for interconnecting the back tray and the thickness tray of a food processing machine to the same frame. Mounting both trays to a single frame keeps the trays aligned. Furthermore, the frame is removable, thereby making removal of the back and thickness trays easy for ease in cleaning.

The invention is a tray and blade guide frame apparatus for a food slicing machine. The food slicing machine has a machine frame to which a reciprocally displaced, workpiece-retaining carriage is connected. The food slicing machine also has a thickness tray on which a food workpiece slides, a back tray on which the food workpiece slides, and a cutting blade positioned near an edge of the back tray.

The tray and blade guide frame apparatus includes at least one tray and blade guide frame member extending longitudinally from the back tray to the thickness tray. The frame member is rigidly mounted to the back tray and the thickness tray, and is removably connected to the machine frame adjacent the workpiece-retaining carriage.

The invention also includes a blade guide mounted to the edge of the back tray. The blade guide has a slot formed in one side, and the slot is adapted to retain a portion of the cutting blade.

Figure 1:
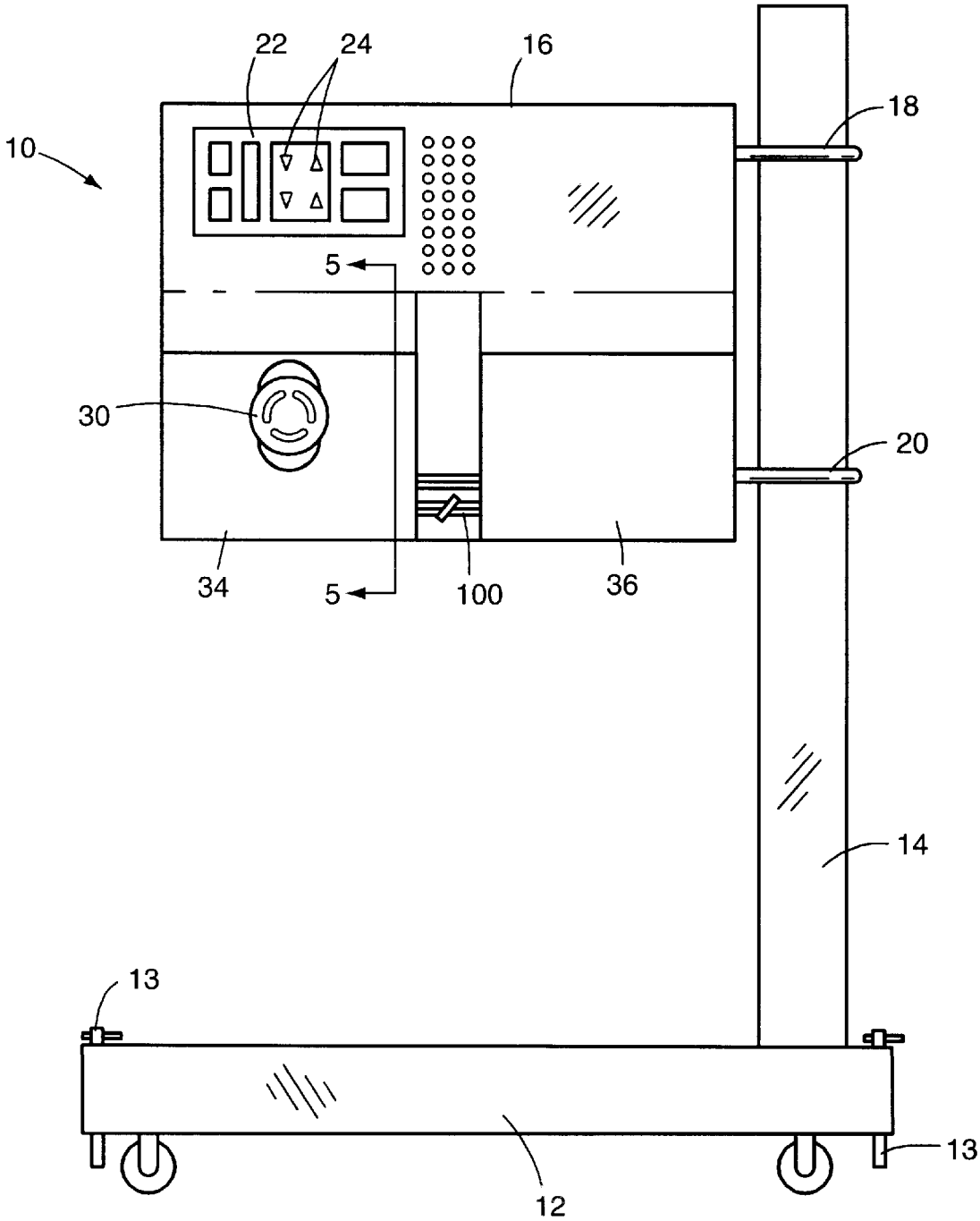
FIG. 1 is a front view illustrating a preferred embodiment of the present invention.
Figure 2:
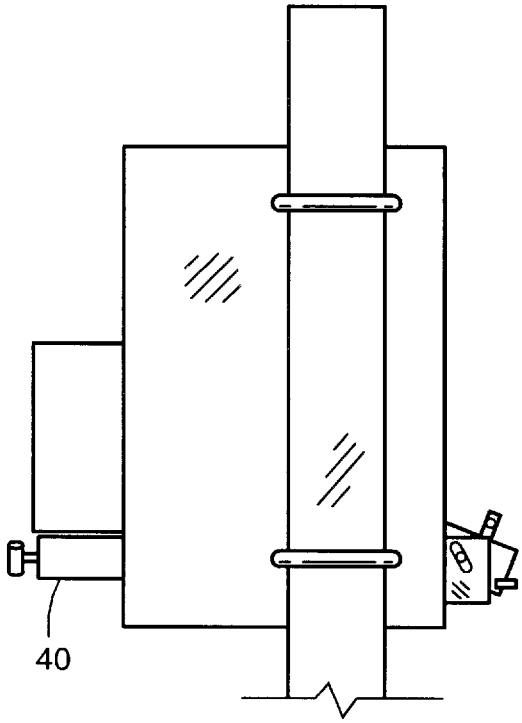
FIG. 2 is a side view illustrating the embodiment of FIG. 1.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

BRIEF DESCRIPTION OF THE PREFERRED EMBODIMENT

The preferred food product slicing machine 10 is shown in FIG. 1. A vertical post 14 is rigidly fixed to a horizontal base 12. The base 12 has casters to permit movement of the machine 10, once conventional levelers 13 are released. A housing 16 is rigidly mounted to the vertical post 14 by an upper U-bolt 18 and a lower U-bolt 20 which attach to the side of the housing 16 and extend around the vertical post 14. The housing 16 is vertically adjusted by loosening the U-bolts 18 and 20, moving the housing 16, and re-tightening the U-bolts 18 and 20. The U-bolts 18 and 20 can alternatively be attached to the opposite side of the housing 16. The housing 16 contains the mechanical slicing mechanisms and the computer control devices for the food product slicing machine 10.

Figure 3:
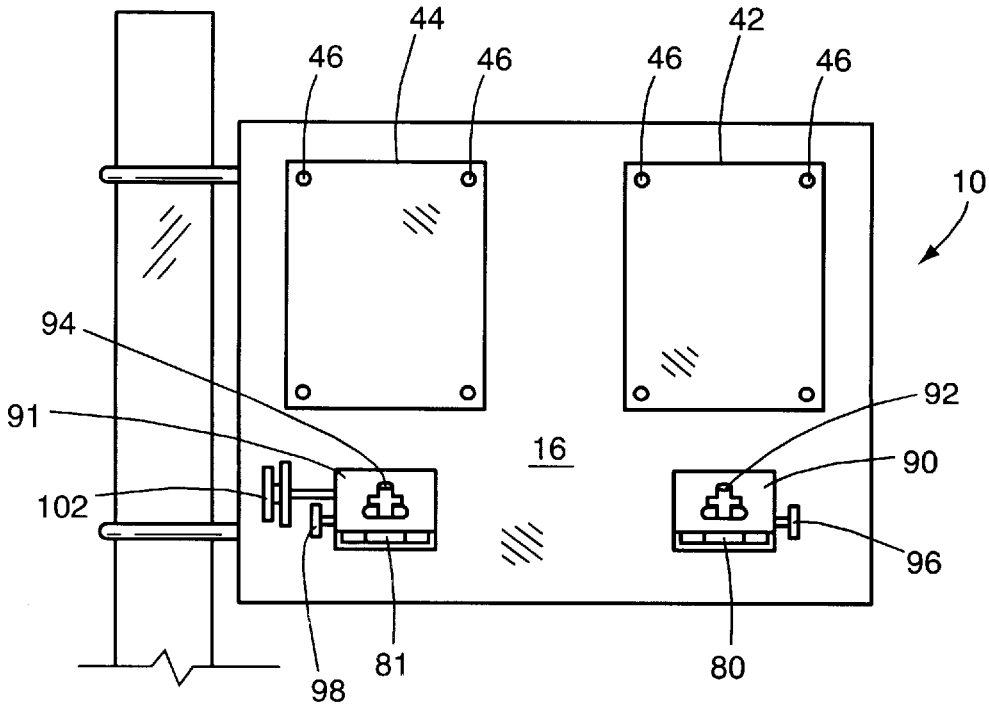
FIG. 3 is a rear view illustrating the embodiment of FIG. 1.

A computer control 22 is visible through an aperture in the front panel of the housing 16. A plurality of finger-actuatable controls 24 permit the operator to input commands to the computer control 22 for controlling the operation of the machine 10. A drive motor 30 is mounted to a first door 34, which is hingedly mounted at its outward lateral edge to one side of the housing 16. A second door 36 is hingedly mounted at its outward lateral edge to the opposite side of the housing 16. A computer access panel 42 and a drive mechanism access panel 44 are retained in place on the rear of the housing 16 by a plurality of fasteners 46 at the corners of the panels 42 and 44, shown in FIG. 3.

Figure 4:
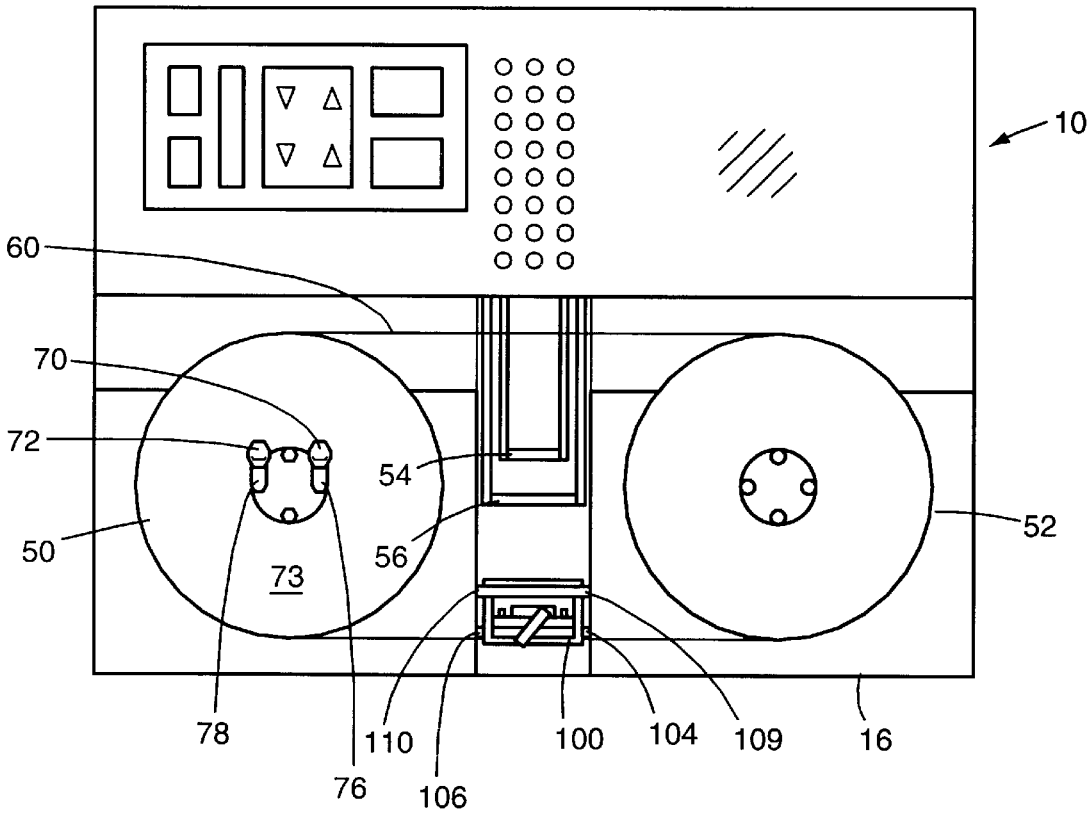
FIG. 4 is a front view illustrating the interior of the preferred housing of the present invention.

Referring to FIG. 4, a driven pulley 50 and an idler pulley 52 are mounted to the machine 10 behind the doors 34 and 36 (which have been removed in FIG. 4). The pulleys 50 and 52 are angled rearwardly from vertical to permit the product retaining carriage (not shown), which attaches to the swing arms 54 and 56, to be displaced rearwardly in its path of oscillation without contacting the upper straight segment of the endless loop blade 60. This angling of the pulleys 50 and 52 positions the lower segment of the endless loop blade 60 forward of the upper segment of the endless loop blade 60. The lower segment of the blade 60 can thereby cut the food product without the upper segment interfering with the carriage which oscillates in a path above and on both front and rear sides of the lower segment. The angling of the pulleys 50 and 52 rearwardly is conventionally known, and the angle between the pulleys 50 and 52 and vertical is approximately 25°.

Figure 5:
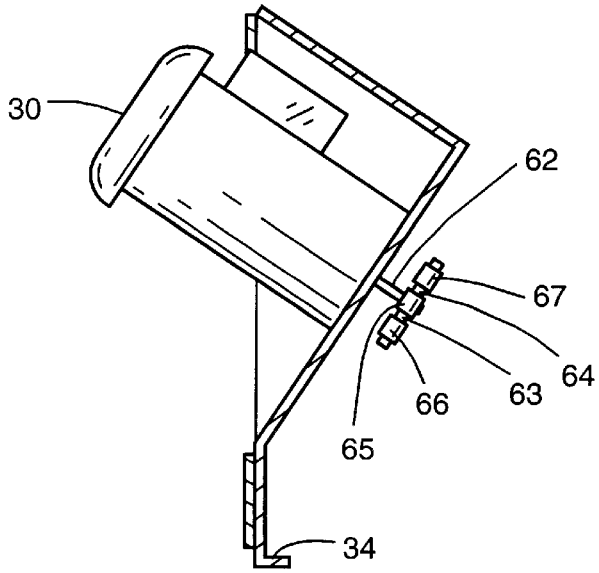
FIG. 5 is a side view in section along the lines 5—5 of the embodiment shown in FIG. 1.
Figure 6:
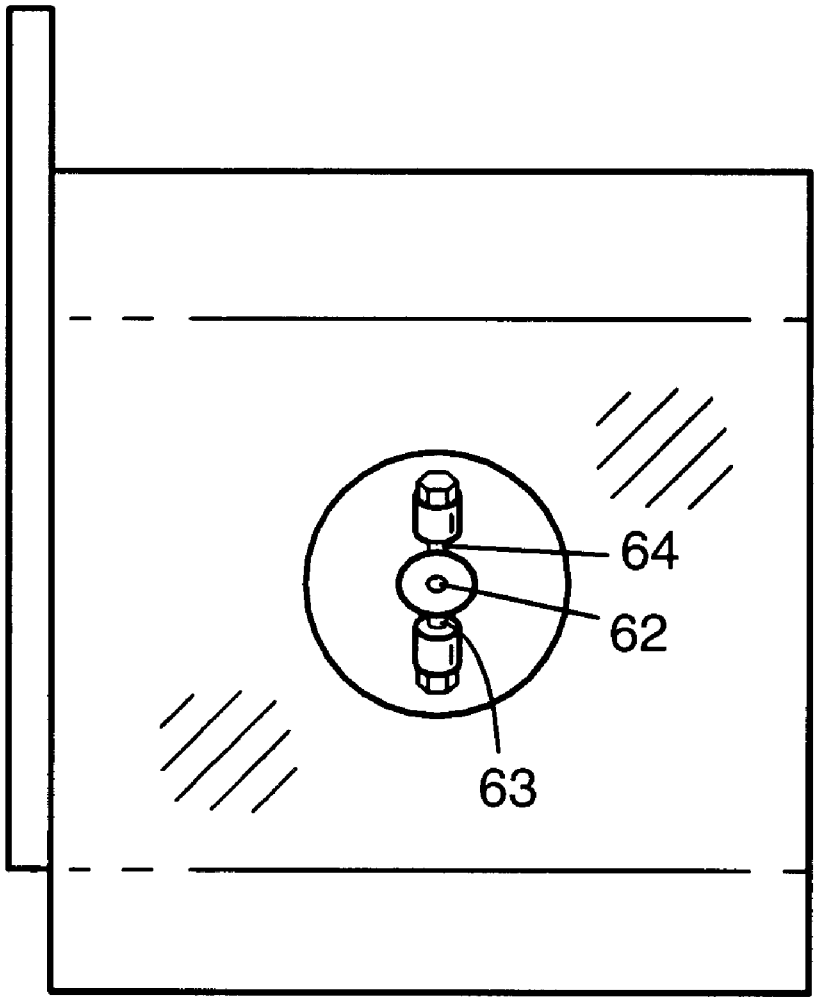
FIG. 6 is a rear view illustrating the inner side of the door 34 shown in FIG. 1.

The pulley 50 is driven by the electric, rotary motor 30, shown in FIG. 5. The motor 30 is mounted to the central region of the door 34 with its driveshaft 62 extending through the door 34. The central region 35 is angled approximately 25° from vertical to substantially match the angle of the pulley 50. When the door 34 is in its closed position, the driveshaft 62 of the motor 30 is positioned near the center of the pulley 50 and the drive motor 30 is coupled to the pulley 50.

A pair of feet 63 and 64 are rigidly fixed to the driveshaft 62, extending radially outwardly from, and preferably perpendicular to, the driveshaft 62. The feet 63 and 64 have a radial component, which is defined as extending, at least partially, in the radial direction. Any part which extends radially outwardly has a radial component, regardless of whether there is also an axial component to the same part. The feet 63 and 64 are, in the preferred embodiment, conventional bolts which mount in threaded orifices on opposite sides of a collar 65. Because the feet 63 and 64 are perpendicular to the driveshaft 62, they have a significant radial component. The collar 65 mounts around the driveshaft 62, and the feet 63 and 64 thread through the collar 65, firmly seating against the outer surface of the driveshaft 62 and fixing the collar 65 rigidly in place relative to the driveshaft 62. The feet 63 and 64 are preferably positioned at approximately 180° intervals around the circumference of the collar 65. Cylindrical bushings 66 and 67 extend circumferentially around the feet 63 and 64 and are clamped in place between the heads of the feet 63 and 64 and the collar 65. The bushings 66 and 67 are preferably an elastic material, such as conventional synthetic rubber, to provide smooth, quiet engagement of the feet 63 and 64 with other machine components.

A pair of fingers 70 and 72 extend outwardly from the face 73 of the driven pulley 50 forming a gap between the fingers 70 and 72. The fingers 70 and 72 are preferably parallel, conventional bolts equidistantly spaced on opposite sides of, and parallel to, the axis of rotation of the pulley 50. It is not necessary that the fingers 70 and 72 be equidistant from the axis, but because the pulley 50 rotates at high speed, balancing the weight distributed around its axis prevents wobbling during rotation. Additionally, the fingers 70 and 72 do not have to be parallel to the axis of rotation of the pulley 50. However, the holes into which the fingers 70 and 72 mount are most easily formed perpendicular to the face 73, which positions the mounted fingers 70 and 72 parallel to the pulley's axis.

Cylindrical rollers 76 and 78 are rotatably mounted about the outer, circumferential surfaces of the fingers 70 and 72, respectively. The rollers 76 and 78 operate as bearing surfaces against which the bushings 66 and 67 seat. The rollers 76 and 78 are preferably a low friction nylon, such as that sold under the trademark DELRIN.

Figure 7:
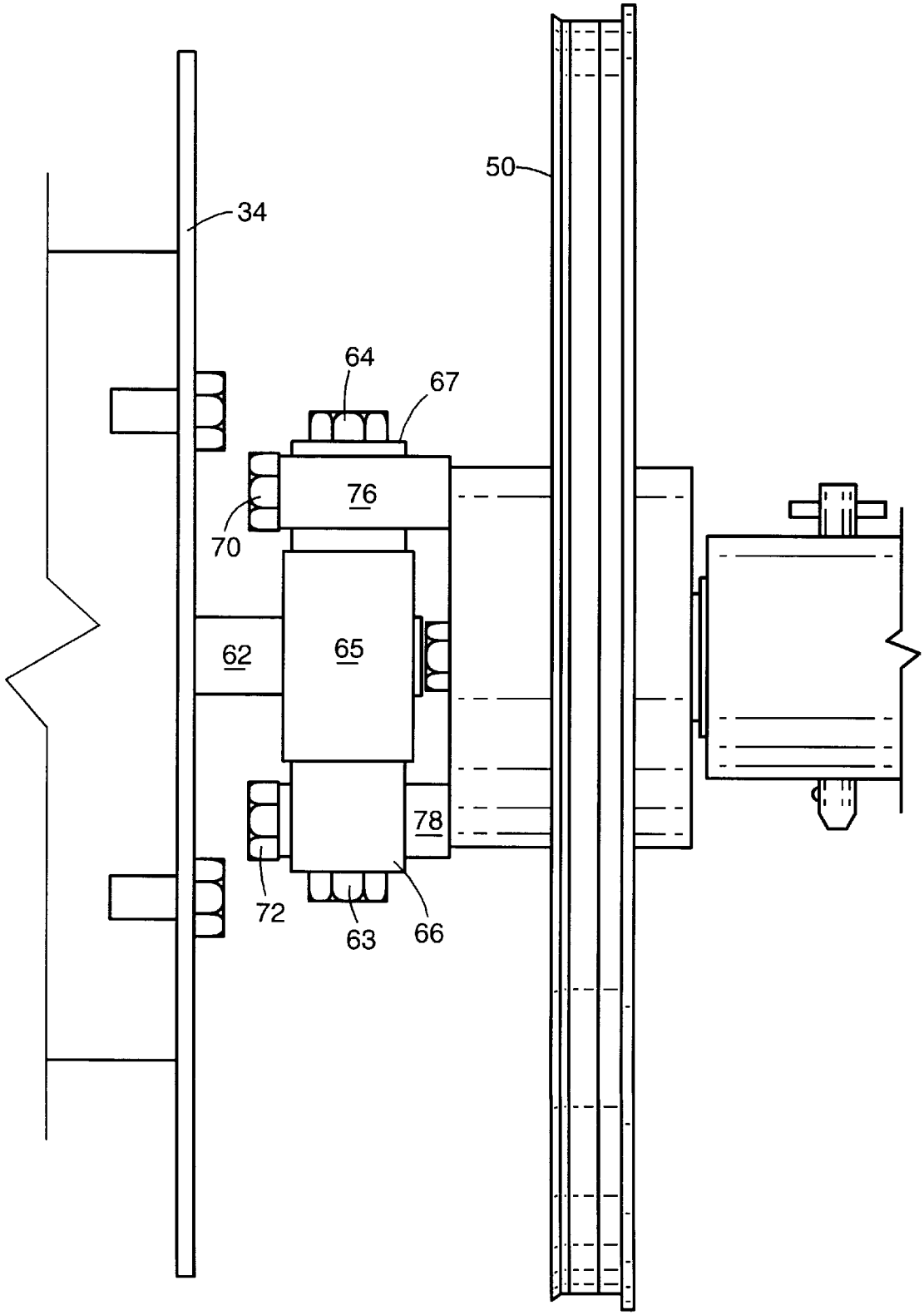
FIG. 7 is a side view illustrating the preferred coupling.

When the coupling is engaged, the end of the driveshaft 62 preferably extends into the gap between the fingers 70 and 72. A close-up side view of the driveshaft 62 disposed between the fingers 70 and 72 is shown in FIG. 7. Before the door 34 pivots closed to the position shown in FIG. 7, the feet 63 and 64 must be positioned out of the way so they do not seat against the fingers 70 and 72 during closing. This is preferably done by placing the feet 63 and 64 transverse, and ideally approximately perpendicular, to a line connecting the fingers 70 and 72. This positioning allows the door 34 to close without the resistance caused by the bushings 66 and 67 contacting the fingers 70 and 72.

Once the door 34 is closed and the coupling engaged, portions of the driveshaft 62, the collar 65 and the bushings 66 and 67 are preferably positioned in the gap between the fingers 70 and 72. The fingers 70 and 72 preferably extend beyond the feet 63 and 64, and the feet 63 and 64 preferably extend beyond the fingers 70 and 72. This allows some fluctuations in alignment of the components while maintaining their engaging relation. Of course, the feet 63 and 64 could extend axially toward the driven pulley 50 and then curve radially outwardly near the pulley 50. This would keep the driveshaft 62 and collar 65 out of the gap if this is desired. When the motor is actuated, the driveshaft 62 rotates, rotating the feet 63 and 64 about the axis of the driveshaft 62. The elastic bushings 66 and 67 seat against the rollers 76 and 78, exerting a force against the fingers 70 and 72, and rotatingly driving the pulley 50.

The relative sizes of the components of the coupling, in combination with their spacing, permits the components to be misaligned while still providing an effective coupling between the driveshaft 62 and the pulley 50. It is preferred that the axis of the driveshaft 62 is close to being coaxial with the axis of the pulley 50 when the coupling is engaged. However, perfect coaxial alignment is rarely achievable, because the time involved in aligning the two axes is significant. It is also possible for the axes to be approximately parallel, but relatively far from coaxial. Achieving even this alignment can be time consuming. The present invention permits the axes to be transverse or skew and the coupling will still operate effectively. It is not unusual for there to be a compound angle between the axes. The coupling, however, will still be effective under these conditions. This is because as long as at least one of the feet 63 and 64 can apply a force to at least one of the fingers 70 and 72, the pulley 50 will be rotatingly driven, as long as the force applied generates a moment arm between the finger and the axis of rotation of the pulley. This force can be applied with the preferred coupling even when the engaged parts are misaligned.

The elastic bushings 66 and 67 provide quiet contact between the feet 63 and 64 and the fingers 70 and 72. Although the bushings 66 and 67 preferably are not appreciably rotatable, they can be made to be rotatable. The rollers 76 and 78, however, are freely rotatable. The rollers 76 and 78 reduce the friction between the bushings 66 and 67 and the fingers 70 and 72 by translating any force applied to the fingers 70 and 72 which has a component tangential to the roller 76 or 78, into rotational movement of the rollers 76 and 78. If the rollers 76 and 78 were not rotatable, the bushings 66 and 67 could rub against the fingers 70 and 72, generating friction.

The dimensions and relative positioning of the coupling components permits easy engagement and disengagement of the coupling. Since the door 34 is hingedly attached to the housing 16 about a vertical axis, pivoting of the door 34 from a closed to an open position is easily accomplished by hand, displacing the driveshaft 62 and attached elements along an arcuate path as the coupling is disengaged. As the driveshaft 62 is subsequently displaced along the arcuate path toward the pulley 50, it is not difficult to manually position the fingers 70 and 72 out of the path of the feet 63 and 64 (or vice versa) before the door 34 is closed and the coupling is engaged. Once the motor 30 is actuated, the feet 63 and 64 rotate to seat the bushings 66 and 67 against the rollers 76 and 78. The torque the motor 30 applies to the driveshaft 62 is coupled to the pulley 50 by a tangential force of the feet 63 and 64 abutting against the fingers 70 and 72. No connection need be made between the feet 63 and 64 and the fingers 70 and 72 other than mere abutment. Because only abutment is necessary for the coupling to be engaged, misalignment can be severe so long as abutment between at least one foot and one finger exists. Furthermore, the need for only abutment facilitates easy uncoupling, since unseating each component from another only requires one to be withdrawn from the other in virtually any direction.

Mounting the motor 30 on the pivotable door 34 provides an unexpected safety feature. The inventors have discovered that while the driveshaft 62 is rotating and the coupling is engaged, it is very difficult to open the door 34. It is believed this is due to the rotation of the pulley 50 about one axis, and the resistance between the feet 63 and 64 and fingers 70 and 72 to the driveshaft 62 being withdrawn along an arcuate path which positions the axis of rotation of the driveshaft 62 at an ever increasing angle to the axis of the pulley 50. This safety feature prevents the door 34 from being opened until the pulley 50 has stopped rotating.

Figure 8:
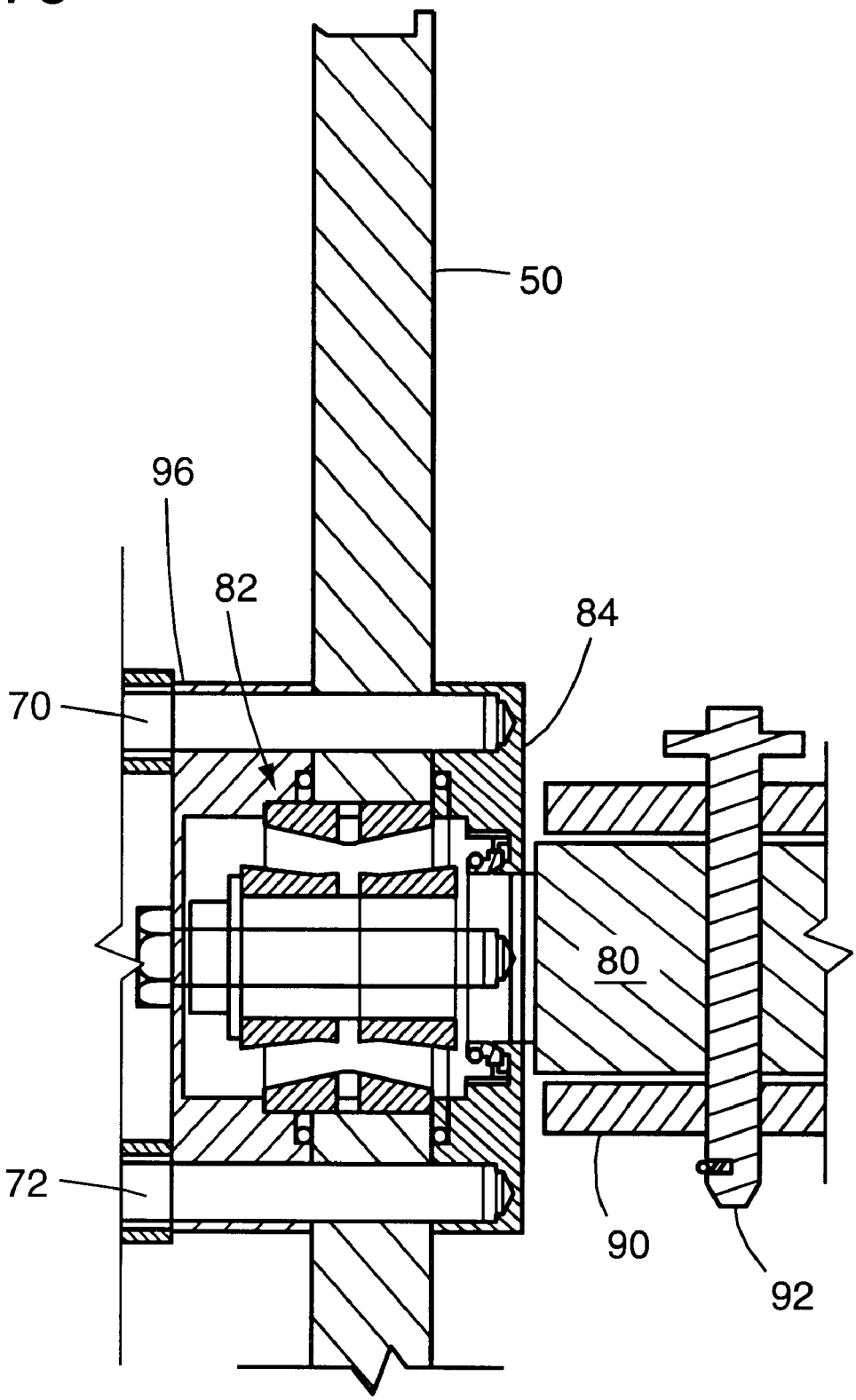
FIG. 8 is a side view in section illustrating the embodiment shown in FIG. 7.

The coupling also permits easy removal of the pulleys 50 and 52. The pulleys 50 and 52 are rotatingly mounted to studs 80 and 81, respectively, by a roller bearing apparatus. The roller bearing apparatus 82 for the pulley 50 is shown in FIG. 8, and the roller bearing apparatus for the pulley 52 is substantially identical. A rear hub 84 and a front hub 86 seat against opposite sides of the pulley 50 and enclose the roller bearing apparatus 82. The roller bearing apparatus 82 is a conventional bearing structure which restricts axial movement of the pulley 50 relative to the stud 80. The fingers 70 and 72 extend through the front hub 86 and the pulley 50, threadingly engaging the rear hub 84, and clamping the pulley 50 between the front and rear hubs 84 and 86.

Referring again to FIG. 3, the studs 80 and 81 extend through the rear of the housing 16 into a pair of channel members 90 and 91. The channel members 90 and 91 are rigidly attached to the housing 16 at an angle of about 25° from horizontal and retain the studs 80 and 81 in position. Pivot pins, such as the first hitch pin 92 and the second hitch pin 94, extend downwardly through holes formed through the tops of the channel members 90 and 91 through passageways formed in the studs 80 and 81, respectively. The distal ends of the hitch pins 92 and 94 protrude through holes formed through the bottoms of the channel members 90 and 91, forming a pivot about which the studs 80 and 81 can rotate.

The pulleys 50 and 52 can be laterally pivoted into position by a pair of adjusting rods 96 and 98, respectively. The adjusting rods 96 and 98 have a hand-grippable knob at outer longitudinal ends, and their threaded shafts thread through the outward side of the channel members 90 and 91. The inner ends of the rods 96 and 98 seat against the sides of the studs 80 and 81 at a point which is offset, along the length of the stud, from the hitch pins 92 and 94. Thus, tightening one of the adjusting rods 96 or 98 applies a force to it, causing the stud 80 or 81 to pivot about the hitch pin 92 or 94, thereby displacing the pulley 50 or 52 laterally. By rotating the adjusting rods 96 and 98 clockwise, the studs 80 and 81 are caused to pivot about the hitch pins 92 and 94, tightening the endless loop blade 60 due to the increased distance between the pulleys 50 and 52. The distance between the pulley ends of the studs 80 and 81 is normally greater than the distance between the opposite ends, since the pulleys are desirably angled laterally to tighten the endless loop blade 60 and bias it to the rear of the pulleys 50 and 52. This results in a lateral angle between the axis of the pulley 50 and the driveshaft 62.

The idler pulley adjusting rod 102 seats against the stud 81 at a point which is near the hitch pin 94. Therefore, when the adjusting rod 102 is tightened or loosened, the entire stud 81 is displaced laterally without significant pivoting of the stud 81 about the hitch pin 94.

Removal of the pulleys 50 and 52 is easily and quickly accomplished, requiring no tools. The hitch pins 92 and 94 are removed by hand from the channel members 90 and 91. After the doors 34 and 36 are opened, disengaging the motor 30 from its coupling with the driven pulley 50, the pulleys 50 and 52 are moved slightly toward one another. This creates slack in the endless loop blade 60, allowing it to be removed from the pulleys 50 and 52. The pulleys 50 and 52 are then separately removed by pulling with both hands, which withdraws the studs 80 and 81 from the channel members 90 and 91. Reattachment of the pulleys 50 and 52 is accomplished by reversing these steps. If any adjustments are needed, they are done by rotating the adjusting rods 96, 98 and 102 by hand. No adjustment to align the axis of the pulley 50 with the axis of the driveshaft 62 is needed, since their alignment can be approximate.

In addition to the ease in removal of the pulleys 50 and 52 for cleaning, there are other parts of the machine 10 which are easily removed. As is described in the patents referenced above, a food product workpiece is retained by a workpiece retaining carriage 89 (shown in FIG. 14) which is reciprocatingly displaced through a cutting path. In the present invention, the path through which the workpiece retaining carriage is reciprocated is arcuate, although the present invention would function if the path were linear. The workpiece retaining carriage 89 is a conventional structure, which is mounted to the drive bars 54 and 56. The workpiece retaining carriage 89 clamps a workpiece, such as an elongated log of salami, between the elongated, U-shaped members 68 and 69, extending the workpiece downwardly toward, and into contact with, a tray and blade guide frame 100.

Figure 9:
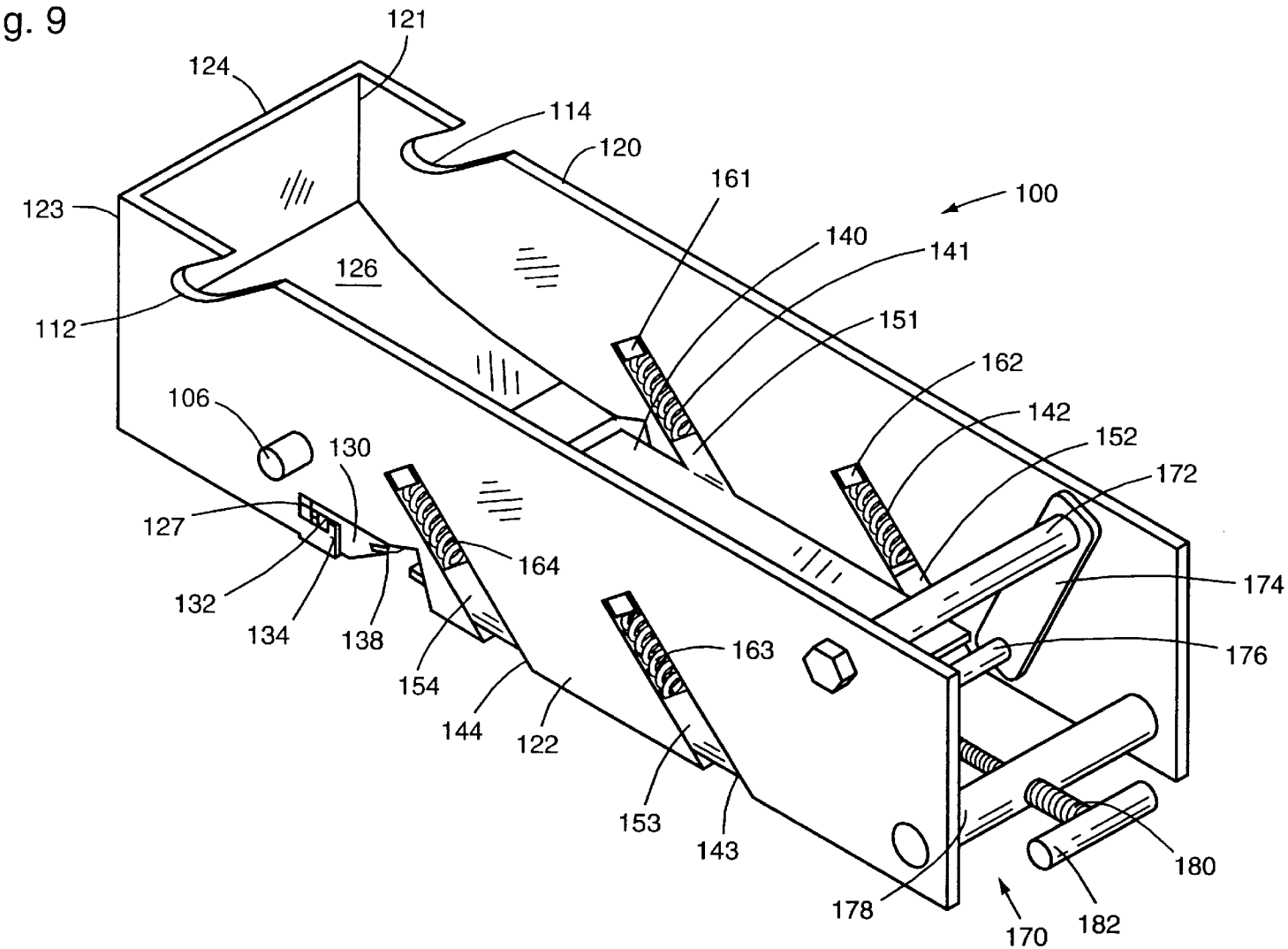
FIG. 9 is a view in perspective illustrating the preferred tray and blade guide frame.

The tray and blade guide frame 100 removably attaches to the housing 16, as shown in FIG. 4, by a pair of pins 104 and 106 which are rigidly fastened to the tray and blade guide frame 100, and extend outwardly into corresponding slots formed in the housing 16. A second pair of pins 108 and 110 extend inwardly from rigid attachment to the housing 16 into slots 112 and 114 formed in the tray and blade guide frame 100. Referring to FIG. 9, two longitudinal frame members 120 and 122 are integrally attached at one end to an end frame member 124. Preferably the longitudinal frame members 120 and 122, and the end frame member 124 are formed from a single, elongated piece of 10 gauge steel bent at the corners 121 and 123. A back tray 126 is integrally, transversely mounted, preferably by welding, to the longitudinal frame members 120 and 122 and the end frame member 124.

Figure 19:
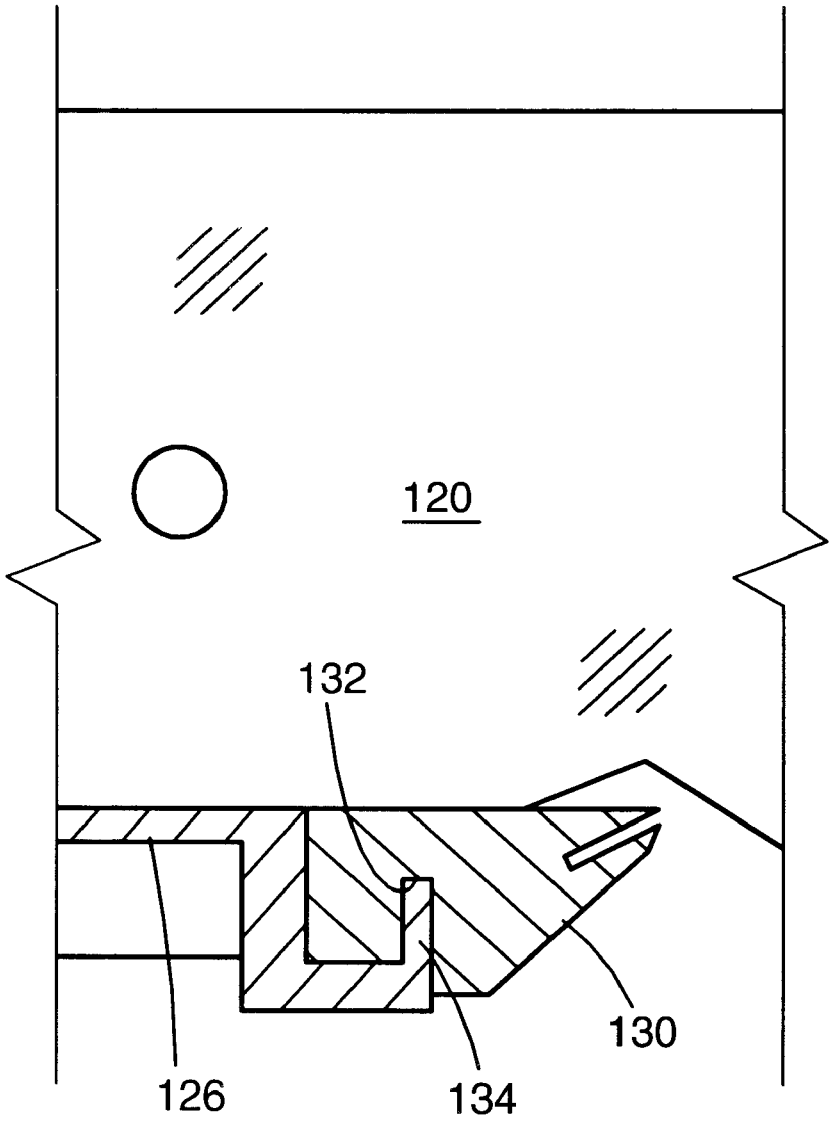
FIG. 19 is a side view in section along the lines 19—19 of FIG. 13.

A blade guide 130 is slidingly mounted to a front edge 127 of the back tray 126. The upper surface of the blade guide 130 is preferably flush with the upper surface of the back tray 126 when the blade guide 130 is in its operable position shown in FIG. 9. Referring to FIGS. 9 and 19, the blade guide 130 is inserted in its mounted position to the tray and blade guide frame 100 by positioning it approximately perpendicular to the longitudinal frame member 120 and inserting a leading end beneath the longitudinal frame member 120, aligning the upwardly facing rib 134 formed on the back tray 126 in the downwardly facing groove 132 in the blade guide 130. The blade guide slides lengthwise until the leading end seats against a stop pin 136 positioned beneath the longitudinal frame member 122 in the path of the blade guide 130. The blade guide 130 is thereby mounted directly to the back tray 126. Therefore, any displacement moves the back tray 126 and the blade guide 130 together, and there is no significant relative motion between them.

The lower straight segment of the endless loop blade 60 (shown in FIG. 4) extends through the slot 138 formed along the length of one lateral side of the blade guide 130. The slot 138 and the retaining of the blade therein is conventional. The endless loop blade 60 travels clockwise in the drawing of FIG. 4, and the frictional force of the blade travelling against the inner surfaces of the slot 138 tends to retain the blade guide 130 in abutment against the stop pin 136.

A thickness tray 140 is slidably mounted to the longitudinal frame members 120 and 122. Fingers 151, 152, 153, and 154 extend laterally outwardly and curve upwardly from the thickness tray 140, and slidably mount in slots 141, 142, 143 and 144 formed in the longitudinal frame members 120 and 122. The upper ends of coil springs 161, 162, 163, and 164 seat against the upper ends of the slots 141–144, and the lower ends of the springs 161–164 seat against the top edge of the fingers 151–154. The coil springs 161–164 bias the thickness tray 140 downwardly along the path defined by the slots 141–144, into abutment against a thickness tray adjusting mechanism 170.

The thickness tray adjusting mechanism 170 adjusts the position of the thickness tray 140, and includes an upper rod 172 rigidly mounted to the longitudinal frame members 120 and 122. A strut 174 pivotably mounts to the upper rod 172 and extends downwardly to a lower rod 176. The lower rod 176 pivotably mounts to the lower end of the strut 174. An intermediate member, preferably the intermediate rod 178, pivotably mounts to the longitudinal frame members 120 and 122. A threaded shaft 180 extends through threaded orifices in the intermediate rod 178 and the lower rod 176. The number of threads per inch of the portion of the shaft 180 at the intermediate rod 178 differs from the number of threads per inch of the portion of the shaft 180 at the lower rod 176. Therefore, rotation of the attached handle 182 in one direction causes the threaded shaft 180 to rotate within both the intermediate rod 178 and the lower rod 176, thereby displacing the lower rod 176 toward the intermediate rod 178. Rotation of the handle 182 in the opposite direction causes the lower rod 176 to move in the opposite direction relative to the intermediate rod 178.

Figure 10:
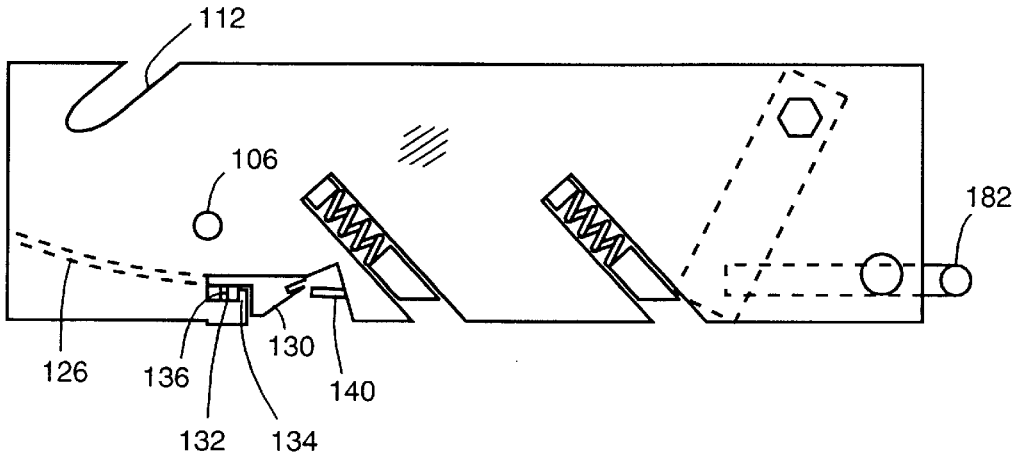
FIG. 10 is a side view illustrating the preferred tray and blade guide frame.
Figure 11:
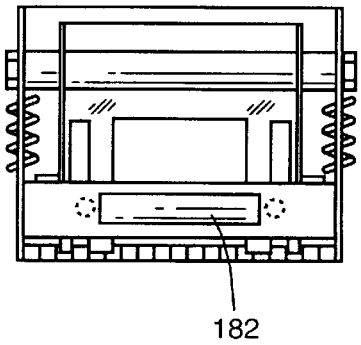
FIG. 11 is an end view illustrating the preferred tray and blade guide frame.
Figure 12:
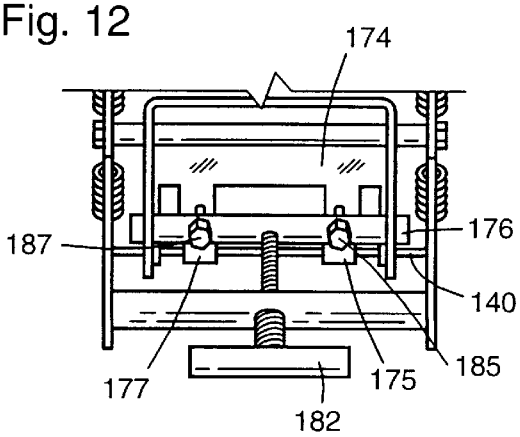
FIG. 12 is an end view in perspective illustrating the tray and blade guide frame.
Figure 13:
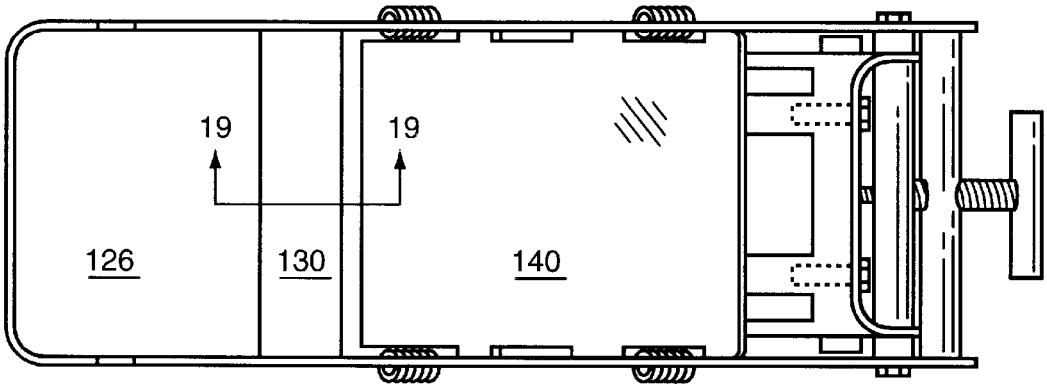
FIG. 13 is a top view illustrating the preferred tray and blade guide frame.

The strut 174 has a pair of tabs 175 and 177 which extend downwardly between the lower rod 176 and the end of the thickness tray 140, as seen in FIGS. 10, 11 and 12. A pair of levelling screws 185 and 187 extend through the lower rod 176 and seat against the front of the tabs 175 and 177, respectively. The tabs 175 and 177 seat, at their rear, against the proximal end of the thickness tray 140. When a levelling screw is individually tightened or loosened, it displaces the lateral side of the thickness tray 140 it contacts. This causes displacement of one lateral side of the distal end of the thickness tray 140 (near the blade guide 130). By adjusting the levelling screws, the operator can finely adjust (on a chosen lateral side) the distance between the upper surface of the thickness tray 140 and the cutting surface of the endless loop blade 60. This makes the resulting slice have equal thickness on each lateral side.

Figure 15:
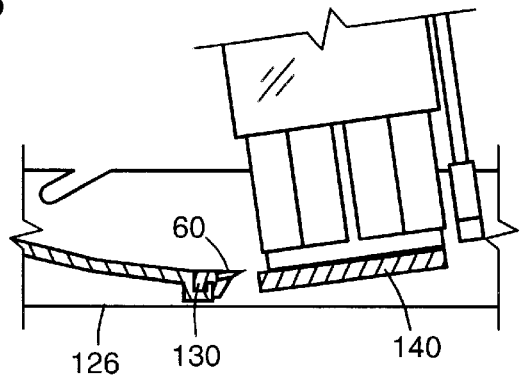
FIGS. 15–18 are side views in section illustrating, in sequence, four steps in the slicing operation of the present invention.

Rotation of the handle 182 causes the entire thickness tray 140 to be displaced, which changes the overall thickness of the slice subsequently formed. The thickness tray 140 is displaced along the path formed by the slots 141–144, which has components in both the x and y directions. The y direction is defined as perpendicular to the upper surface of the thickness tray 140, and the x direction is defined along a line parallel to the path of reciprocation of the workpiece. The lower end of the food product workpiece rests on the upper surface of the thickness tray 140 (as shown in FIG. 15 before cutting begins).

Figure 16:
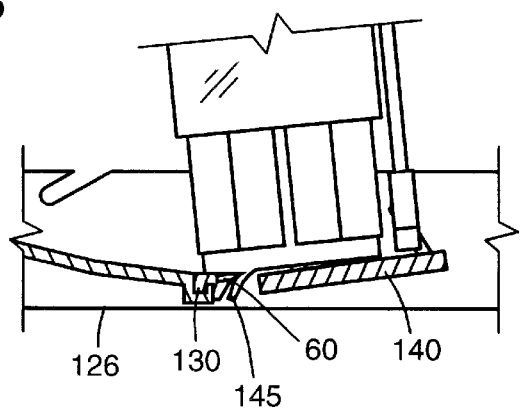
Figure 17:
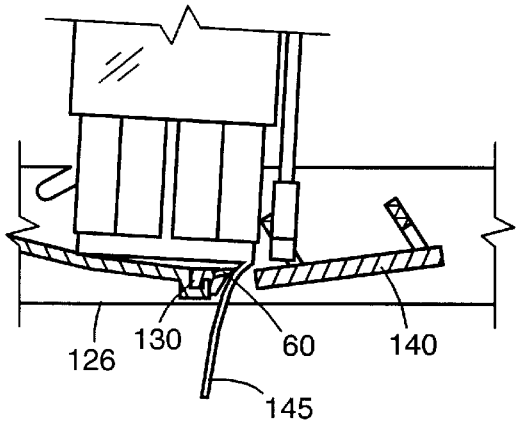
Figure 18:
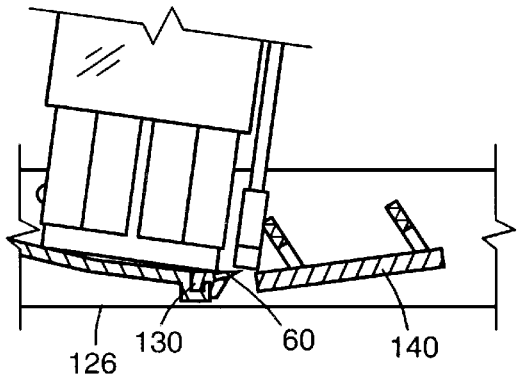

The distance in the y direction between the upper surface of the thickness tray 140 and the cutting edge of the endless loop blade 60 defines the slice thickness. When the food product is displaced, it slides against the upper surface of the thickness tray 140 into the blade 60. A slice 145 is removed from the workpiece as it advances through the blade 60 as shown in FIGS. 16 and 17. The x direction component of the gap between the cutting edge of the endless loop blade 60 and the edge of the thickness tray 140 affects the ability of the slice 145 to fall downwardly after being sliced. The lower end of the workpiece that remains above the blade 60 slides against the upper surface of the blade guide 130 and the back tray 126 as shown in FIG. 18. When the food product reaches its limit of displacement, it is displaced backwardly across the blade guide 130 and onto the thickness tray 140, and gravity causes the food product workpiece to drop downwardly a distance equal to the slice thickness to the upper surface of the thickness tray 140.

The slots 141–144 in which the thickness tray is mounted are preferably angled at 550 relative to the upper surface of the thickness tray 140. This angle guides the thickness tray 140 along the desired path. This path has a component in the y direction which exceeds the component in the x direction for a specific displacement. Therefore, a specific displacement of the thickness tray 140 along the slots 141–144 has a greater y component than x component. It is illustrative to note that angling the slots 141–144 at 45° would result in displacements having equal x and y components. Experience has indicated, however, that a 55° angle is preferred, although angles which differ from 55° have particular advantages and disadvantages for given food products. The exact angle used depends upon engineering compromise in consideration of the above principles.

Figure 14:
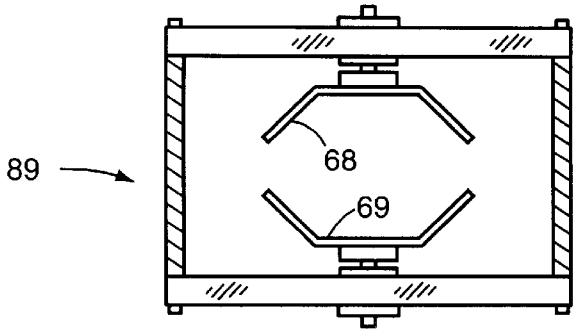
Fig. 14 (Prior Art)
FIG. 14 is a top view illustrating a conventional workpiece retaining carriage.

The tray and blade guide frame 100 is mounted in position as shown in FIG. 4, and a workpiece retaining carriage, such as the carriage 89 shown in FIG. 14, is mounted to the swinging bars 54 and 56. A food product workpiece is retained in the carriage 89 and extends downwardly to rest on the thickness tray 140. Once the slice thickness is adjusted by rotating the handle 182, and the levelling screws 185 and 187 have been adjusted to provide equal thickness on opposite lateral sides of the thickness tray 140, slicing is commenced. A conventional electric or hydraulic drive motor is used to oscillatingly displace the swinging bars 54 and 56, and therefore the carriage 89, in a manner which is conventional for machines of the type shown in the referenced patents.

After slicing, it is necessary to clean the tray and blade guide frame 100. The endless loop blade 60 slides off of the pulleys 50 and 52 as described above, and out of the slot 138 in the blade guide mount 130 toward the operator. The entire tray and blade guide frame 100 then detaches from the housing 16 by removing the pins 104, 106, 108 and 110 from their corresponding slots, and the tray and blade guide frame 100 is submersed in a bath for cleaning. Reattachment is accomplished by reversal of these steps.

The preferred tray and blade guide frame 100 is approximately 6 inches wide and 14 inches long. The tray and blade guide frame 100 can be made wider or narrower, in addition to longer or shorter. However, increasing the width can decrease the rigidity of the tray and blade guide frame 100. Therefore, it may be more desirable in general to align two or more tray and blade guide frames parallel to one another in the same machine rather than increase the width of a tray and blade guide frame.

A significant advantage of the tray and blade guide frame 100 is its unitary structure separate, and detachable in the preferred embodiment, from the frame of the machine 10. Because of the separate, unitary structure, there is a decreased probability of the trays and blade guide being displaced relative to one another. The longitudinal frame members 120 and 122 attach directly to the machine frame at the housing 16. Displacement of the opposite sides of the machine frame relative to one another causes no substantial displacement of the blade guide 130 relative to the thickness tray 140 and back tray 126. This is because the back tray 126 (to which the blade guide 130 is mounted) and the thickness tray 140 both mount to the longitudinal frame members 120 and 122 which form a rigid structure. Unless the longitudinal frame members 120 and 122 are displaced relative to one another, the thickness tray 140 will maintain its position relative to the blade guide 130, thereby assuring consistent thickness slices.

Attachment of the tray and blade guide frame 100 to the machine 10 with pins mounted in slots reduces the probability of the housing 16 exerting enough force on the longitudinal frame members 120 and 122 to displace them relative to one another. Any force applied to the longitudinal frame members 120 and 122 will merely shift the tray and blade guide frame 100 as a unit relative to the machine frame. The entire tray and blade guide frame 100 may be moved, but displacement of the machine frame will not cause relative displacement between the longitudinal frame members 120 and 122. Therefore, movement of the machine frame can, at worst, move the entire tray and blade guide frame 100 relative to the food product workpiece in the carriage 89. However, this will only cause slices to be formed on a different part of the tray and blade guide frame 100 rather than creating differing thickness slices as in the prior art.

While certain preferred embodiments of the present invention have been disclosed in detail, it is to be understood that various modifications may be adopted without departing from the spirit of the invention or scope of the following claims.

We claim:

1. A tray and blade guide frame apparatus for a food slicing machine having a machine frame to which a reciprocally displaced, workpiece-retaining carriage is connected, said food slicing machine also having a thickness tray that is connected to the machine frame and on which a food workpiece slides, a back tray that is connected to the machine frame and on which the food workpiece slides, and a cutting blade positioned near an edge of the back tray, the tray and blade guide frame apparatus comprising:

(a) at least one tray and blade guide frame member extending longitudinally from the back tray to the thickness tray, said frame member being rigidly mounted to the back tray and the thickness tray and removably connected to the machine frame adjacent the workpiece-retaining carriage; and (b) a blade guide mounted to the edge of the back tray, said blade guide having a slot formed in one side, said slot adapted to retain a portion of the cutting blade.

2. A tray and blade guide frame in accordance with claim 1, wherein the blade guide is removably, slidably mounted to the edge of the back tray.

3. A tray and blade guide frame in accordance with claim 1, wherein the elongated tray and blade guide frame member comprises first and second substantially parallel, elongated panels, the first panel having a long edge mounted to a first lateral edge of the back tray, the second panel having a long edge mounted to a second, opposite lateral edge of the back tray.

4. A tray and blade guide frame in accordance with claim 3, further comprising fingers extending outwardly from opposite sides of the thickness tray and slidably mounting in slots formed in the panels.

5. A tray and blade guide frame in accordance with claim 4, wherein the slots comprise a pair of parallel slots formed in each panel, each slot having a vertical component, each slot retaining a mechanical spring which seats, at one spring end, against an upper terminal slot end formed by an interior edge of the panel in which the slot is formed, and each slot retaining one of the fingers which seats against a second, opposite end of its corresponding spring.

6. A tray and blade guide frame in accordance with claim 4, further comprising a thickness tray adjuster drivingly linked to the thickness tray for displacing the thickness tray along a path defined by the slots.

7. A tray and blade guide frame in accordance with claim 6, wherein the thickness tray adjuster comprises:

(a) a rod mounted to, and extending between, the first and second panels;

(b) a strut member pivotably attached to the rod;

(c) an intermediate member pivotably attached to the first and second panels;

(d) an abutment member attached to the intermediate member by a threaded shaft which extends from a threaded aperture in the abutment member to a threaded aperture in the intermediate member, said abutment member seating against the thickness tray.

8. A tray and blade guide frame in accordance with claim 7, wherein the abutment member further comprises a pair of screws which extend through opposite ends of a bar and seat against a pair of thickness tray tabs extending downwardly from the strut member and abutting the thickness tray.

* * * * *